United States Patent [19]

Browning

[11] 4,416,421

[45] Nov. 22, 1983

[54] HIGHLY CONCENTRATED SUPERSONIC LIQUIFIED MATERIAL FLAME SPRAY METHOD AND APPARATUS

[75] Inventor: James A. Browning, Hanover, N.H.

[73] Assignee: Browning Engineering Corporation, Hanover, N.H.

[21] Appl. No.: 287,652

[22] Filed: Jul. 28, 1981

Related U.S. Application Data

[63] Continuation-in-part of Ser. No. 196,723, Oct. 6, 1980, abandoned.

[51] Int. Cl.[3] ..... B05B 7/20

[52] U.S. Cl. ..... 239/79; 239/83; 239/132.3

[58] Field of Search ..... 239/79, 80, 81, 82, 239/83, 84, 85, 132.3, 427, 428, 419, 419.3, 422, 424, 424.5; 219/121 PY, 121 PL, 121 PS, 121 PQ, 121 PP

[56] References Cited

U.S. PATENT DOCUMENTS

| | | | |
|---|---|---|---|
| 2,436,335 | 2/1948 | Simonsen . | |
| 2,544,259 | 3/1951 | Baccini et al. . | |
| 2,920,001 | 1/1960 | Smith et al. . | |
| 3,056,558 | 10/1962 | Gilliland et al. . | |
| 3,131,091 | 4/1964 | Jones . | |
| 4,004,735 | 1/1977 | Zverev et al. . | |
| 4,078,097 | 3/1978 | Miller . | |
| 4,358,053 | 11/1982 | Ingham et al. | 239/79 |

FOREIGN PATENT DOCUMENTS

| | | |
|---|---|---|
| 811899 | 6/1951 | Fed. Rep. of Germany . |
| 953864 | 5/1949 | France . |
| 1041056 | 5/1953 | France . |
| 1437713 | 3/1966 | France . |
| 553099 | 5/1943 | United Kingdom . |
| 733401 | 7/1955 | United Kingdom . |
| 869897 | 7/1961 | United Kingdom . |

*Primary Examiner*—James B. Marbert

*Attorney, Agent, or Firm*—Sughrue, Mion, Zinn, Macpeak, and Seas

[57] ABSTRACT

Within ultra high velocity flame spray apparatus, the oxy-fuel products of combustion under pressure exit from an internal burner and pass through a spray nozzle of extended length. Metal or ceramic material in thin diameter rod form or as particles are fed to the nozzle inlet at a point at or just ahead of the throat of the nozzle bore. The exceptionally long nozzle flow path and the mode of introduction of the material into the flame spray insures a concentrated and highly focussed core of spray material for material spray coating downstream of the nozzle at supersonic speed.

17 Claims, 7 Drawing Figures

FIG. 1
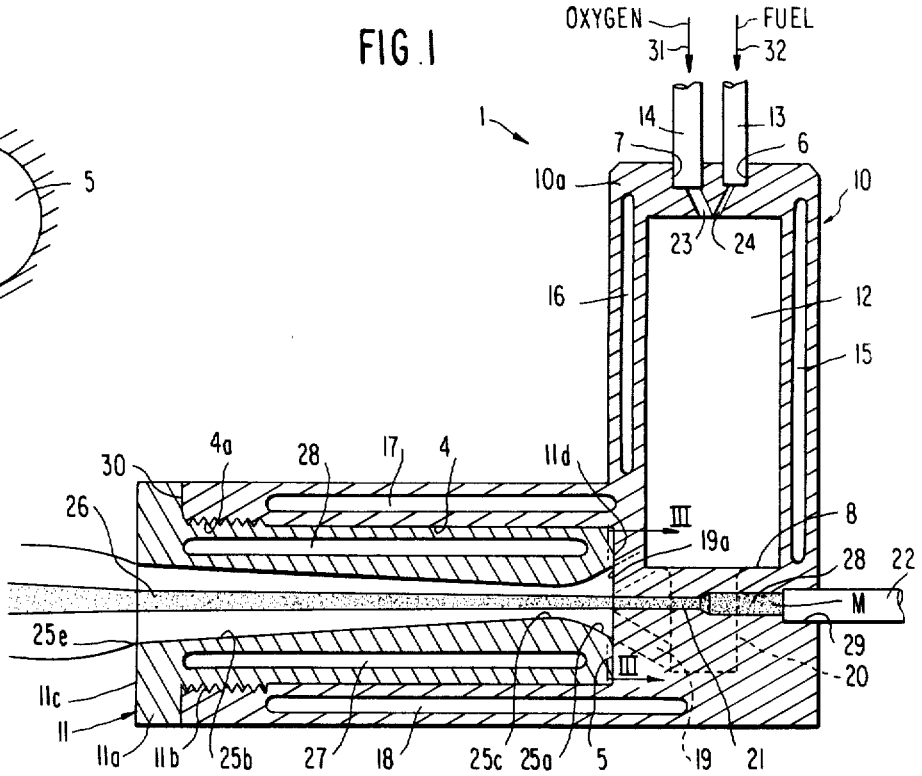
FIG. 3
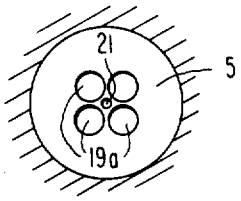
FIG. 2
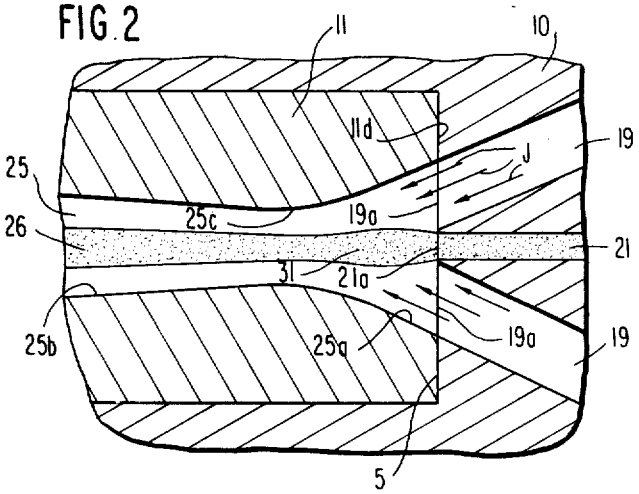
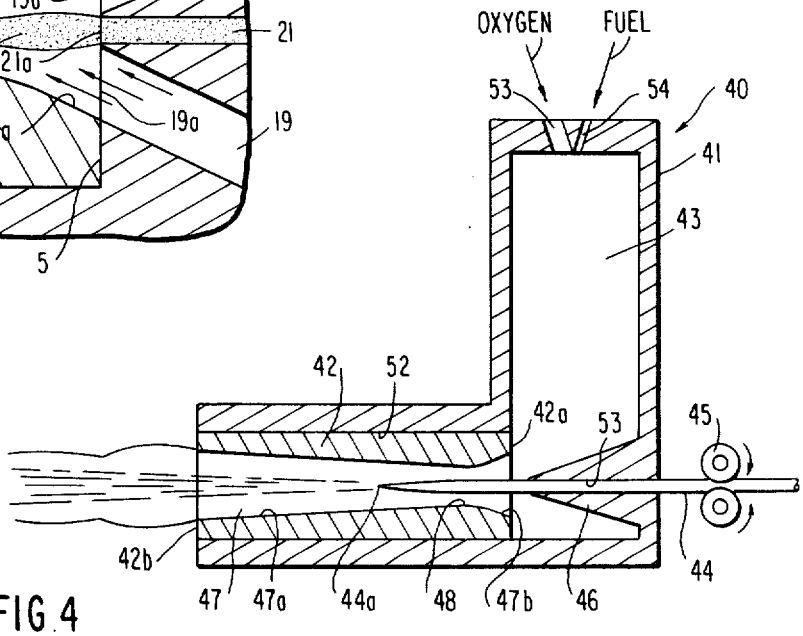
FIG. 4

HIGHLY CONCENTRATED SUPERSONIC LIQUIFIED MATERIAL FLAME SPRAY METHOD AND APPARATUS

This application is a continuation-in-part application of application Ser. No. 196,723 filed Oct. 9, 1980, entitled "Highly Concentrated Supersonic Liquified Material Flame Spray Method and Apparatus", now abandoned.

FIELD OF THE INVENTION

This invention relates to supersonic molten metal or ceramic spraying systems and, more particularly, to a method and apparatus for increasing the temperature and velocity of the molten spray stream to effect flame spray application of particles in liquid form at extremely high supersonic velocities.

BACKGROUND OF THE INVENTION

Attempts have been made to provide flame spray apparatus which include an internal burner operating to produce an ultra-high velocity flame jet. One such ultra-high velocity flame jet apparatus is set forth in my earlier U.S. Pat. No. 2,990,653 entitled "Method and Apparatus for Impacting a Stream of High Velocity Against the Surface to be Treated" issuing July 4, 1961. Such apparatus comprises an air cooled double or triple wall cylindrical internal burner whose interior cavity forms a cylindrical combustion chamber. Downstream of the point of initial combustion, the chamber is closed off by a reduced diameter flame jet nozzle.

In a further attempt to provide such ultra-high velocity flame spraying apparatus for metal, refractory material or the like, introduced to the high velocity flame spray stream in powder form or in solid small diameter rod form, an arrangement was devised involving the utilization of a hot gaseous primary jet stream of relatively low momentum which fuses and projects a stream of molten particles into a second gaseous jet stream of lower temperature, but possessing a very high momentum. Such type of apparatus and method is set forth in my copending U.S. patent application Ser. No. 152,966 filed May 23, 1980, and entitled "Method and Apparatus for Ultra High Velocity Dual Stream Metal Flame Spraying", now U.S. Pat. No. 4,370,538 which issued Jan. 25, 1983. The method and apparatus of my more recent application employs the first stream in the form of an oxy-fuel flame or an electric arc-producing plasma, while the second stream comprises a flame-jet produced by an air/fuel flame reacting at high pressure in an internal burner device. In combining the two streams, preferably the molten particles are carried by the first stream at relatively low velocity but relatively high temperature, while the supersonic jet stream which impinges the entrained molten particles against the surface to be coated at ultra high velocity is discharged from an internal burner combustion chamber wherein combustion is effected at relatively high pressure. The second stream is directed through an annular nozzle surrounding the primary stream. Further, the primary and secondary streams are projected through a nozzle strcture to the point of impact against the substrate to be coated by the liquid particles travelling at supersonic speed, under the acceleration provided by the secondary jet of heated gas.

SUMMARY OF THE INVENTION

The present invention relates to a unique method (and its corresponding apparatus) of using an oxy-fuel internal burner to melt both metallic and ceramic material and accelerate molten particles to supersonic velocities. In particular, the invention relies on the specific manner of introduction of the material in powder or rod form into the flame produced at the internal burner and the provision of an exceptionally long flow path for the flow of metallic or ceramic particles which are supersonically applied at the end of a nozzle of extended length, against a substrate to be coated. Further, the material is introduced to the gas flow at a point ahead of the maximum nozzle restriction or throat, thus confining the particle flow to a small diameter cylindrical core through the center of the nozzle bore. The present invention involves a method and apparatus in which the flow of liquid metal or ceramic droplets may pass through a small diameter nozzle with a path length more than ten times in excess of the nozzle restriction diameter.

Maximum particle velocity may be achieved from an oxy-fuel metallizing internal burner. The burner comprises a nozzle communicating with an upstream internal combustion chamber which burns a fuel with an oxidizer, at elevated pressure. The hot combustion product gases are discharged through the nozzle. A rod or particle flow of metal or other solid material such as ceramic material is introducted into the hot gases for subsequent melting and acceleration. The improvement resides in the introduction point for the solid material to be at or just upstream of the throat of an extended length nozzle.

The solid material in the form of a small diameter rod may be introduced to the gas flow stream from a hole within the nozzle casing aligned with the nozzle throat. Means are provided for providing an inlet flow of hot gas from the internal burner combustion chamber to the nozzle throat which has a radial inlet component of its velocity which tends to restrict the diameter of the column of particles when particulate matter is used or to maximize heat transfer to the rod periphery where the solid material is in small diameter rod or wire form. Preferably, the length of the nozzle bore is at least five times that of the minimum diameter of the nozzle bore. Additionally, the pressure within the combustion chamber should be maintained at 75 PSIG or greater.

BRIEF DESCRIPTION OF THE DRAWINGS

FIG. 1 is a longitudinal, sectional view of one embodiment of the highly concentrated supersonic liquid material flame spray apparatus of the present invention.

FIG. 2 is an enlarged view of the venturi nozzle throat of the apparatus of FIG. 1.

FIG. 3 is a transverse cross-sectional view of a portion of the apparatus of FIG. 1, taken about line III—III.

FIG. 4 is a longitudinal sectonal view of a similar supersonic liquid material flame spray apparatus to that shown in FIGS. 1–3 inclusive, but utilizing a rod feed and forming a second embodiment of the present invention.

DESCRIPTION OF THE PREFERRED EMBODIMENTS

Figure 5:
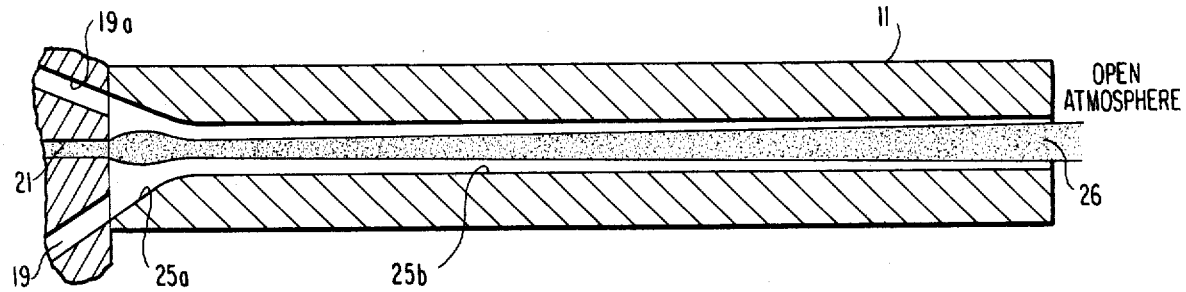
FIG. 5 is a longitudinal sectional view of a nozzle forming a part of a supersonic liquid material flame spray apparatus constituting a further embodiment of the invention.

Referring to FIGS. 1-3 inclusive, there is illustrated in longitudinal, sectional form, and somewhat schematically, the main elements of the improved flame spraying apparatus of the present invention, as one embodiment thereof. The apparatus indicated generally at 1 takes the form of a metal flame spray "gun", being comprised of a main body 10 bearing a threaded cylindrical metal nozzle insert indicated generally at 11. In that respect, the main body 10 which is L-shaped in longitudinal section, bears a cylindrical bore 4 from one end 30 inwardly, terminating at the end of the bore in a transverse wall 5. A portion of the bore 4 is threaded as at 4*a*. Further, the insert 11 which is T-shaped in cross-section, including a radially enlarged flange 11*a*, is threaded as at 11*b* to match the thread 4*a* of body 10, and is in mesh therewith, when assembled. End face 11*c* of the insert 11 faces the substrate being flame spray coated, while the opposite end face 11*d* abuts the bore end face 5 as best seen in FIG. 2. Body 10 is further provided with cylindrical cavity within a portion at right angles to that bearing the nozzle insert 11, the cavity forming an elongated, cylindrical high-pressure combustion chamber 12 providing a restricted volume for the high-pressure combustion of oxygen and fuel, pressure fed to the combustion chamber, as indicated by arrows 31, 32, respectively. An oxygen supply tube or line 14 projects into a cylindrical hole 7 within end 10*a* of body 10. There is also provided an inclined oxygen passage 23, opening to the interior of the combustion chamber 12 at one end and, at the other end, opening to hole 7 bearing the oxygen tube 14. Adjacent the oxygen tube 14 is a second somewhat smaller diameter fuel supply tube 13, the end of which is sealably received within a cylindrical hole 6. Fuel is delivered through a small diameter fuel passage 24 which leads from the fuel inlet tube 13 to the combustion chamber 12. Passage 24 is inclined oppositely to passage 23 and opens to the interior of the combustion chamber adjacent the end of oxygen supply passage 23.

The fuel may be in either liquid or gas form and, if liquid, is aspirated into the oxygen which is fed to the combustion chamber 12 at substantial pressure, thereby forming a fuel air mixture with the fuel in particle form. Continuous burning of a continuous flowing oxy-fuel mixture through the combustion chamber is effected within the combustion chamber 12 by ignition means such as a spark plug (not shown) with burning being initiated at the point of delivery of fuel and air, that is, in FIG. 1, at the upper end of the combustion chamber 12. Combusting of the continuous flowing fuel air mixture occurs confined within an essentially closed internal burner combustion chamber. Annular passages as at 15, 16, 17 and 18 provide cooling of the "gun" body 10; water or other cooling media being circulated through the various annular passages. Additionally, annular passages as at 27, 28 are provided within the nozzle insert for cooling of that member. A circulation loop (not shown) may commonly feed water to all passages indicated above to effectively reduce the external temperature of the flame spray apparatus.

Within the main body 10 are provided multiple inclined holes as at 19 (four in number in the illustrated embodiment) as may be best in FIG. 3, which holes converge towards a point downstream of end wall 5, within bore 4 receiving the nozzle insert 11. The holes 19 open to wall 5 at ports 19*a*. The upper two inclined holes 19 open directly to the lower end of combustion chamber 12, while the lower upwardly and inwardly directed inclined holes 19 open at their upstream ends to combustion chamber 12 by means of a pair of vertical bores 20. Bores 20 which are laterally spaced and to opposite sides of a metal or ceramic powder feed hole 21 of relatively small diameter which opens to end wall 5 of bore 4, to the center of ports 19*a* which thus surround the opening of the powder feed hole 21. The powder feed hole 21 is formed by a small diameter bore which bore is counterbored at 28 and further counterbored at 29. Counterbore 29 receives the projecting end of a powder feed tube 22 which is sealably mounted to the main body 10 in alignment with powder feed hole 21 and counterbore 28. Means are provided (not shown) for supplying a powdered metal or ceramic material M to the powder feed hole 21.

The nozzle insert 11 is provided with converging and diverging bore portions 25*a*, 25*b*, respectively, from end 11*d* towards the end 11*c* and forming a venturi type nozzle passage including a bore throat or constriction 25*c* which is the smallest diameter portion of the flow passage as defined by the intersection of converging and diverging bore portions 25*a*, 25*b*. The converging gas jets indicated by the arrows J, FIG. 2, from the holes 19, combine into a single flow stream converging radially inwardly as the maximum restriction or throat 25*c* of nozzle 11 is approached. The powder M which exits from port or end 21*a* of the powder feed hole 21 is swept radially inwardly or, at the least, is not permitted to expand as it enters the high velocity gas passing into the venturi nozzle of nozzle insert 11, that is, the converging bore portion 25*a* of the nozzle insert 11. Thus, the powder is not permitted to touch the walls of the bore 25 neither at its most narrowed diameter portion, that is, constriction 25*c*, nor over the balance of the bore 25.

For one case tested, the diameter of the constricted portion 25*c* was 5/16 of an inch and the length of bore 25 was four inches. By threading of the nozzle insert 11 and forming this as a separate element from body 10, the nozzle insert may be replaced if it is damaged or upon wear during use as well as to effect change in the configuration and characteristics of the metal flame spray "gun" nozzle portion. By visual observation, it was noted that there exists an essentially cylindrical core 26 of high velocity powder flow centrally through nozzle bore 25 and remote from the surfaces of bore 25. Such cylindrical core is approximately ⅛ inch in diameter. After many extended runs using powders ranging from aluminum to tungsten-carbide-cobalt mixtures, no evidence of powder migration with buildup on the bore walls was ascertained.

Concentration or "focussing" effect by the novel method and apparatus involving specific powder introduction techniques appears to be directly related to the gas flow rate, which for a given nozzle insert may be expressed by the pressure maintained in combustion chamber 12. Detailed photomicrographic studies of the spray coating deposits on the substrate (not shown)

downstream of nozzle discharge port 25*e* indicates both an increased density and coating hardness as the combustion chamber pressure increases. At pressures above 200 PSIG for combustion chamber 12, the coatings appear to be superior to those deposited by plasma spray guns operating with gas temperatures nearly an-order-of-magnitude greater than for the oxy-fuel internal burner of the present invention. It thus appears that the greater velocities available with the oxy-fuel system are more than sufficient to overcome the lesser heat intensity of the unit. To allow sufficient "dwell" time of the particles as at 26 to achieve melting in these in lower temperature gases, relatively long nozzle bore path lengths are required.

Necessarily, the apparatus operating under the method of the present invention requires that the material for deposit, either in powder or in solid form, be introduced into a converging flow of the products of combustion, prior to those products of combustion passing through the narrowest restriction portion of the nozzle. Gas velocities must be extremely high to achieve supersonic particle impact velocities against the surface being coated. Supersonic velocity for the purposes of this discussion, is at ambient atmosphere, about 1200 feet per second. At combustion chamber pressures greater than 200 PSIG, the particles may well travel at speeds above 2000 feet per second and at 50 PSIG for chamber 12, the velocity rises to over 3000 feet per second. Such a velocity is greater than that recorded by detonation gun spraying which heretofore to the knowledge of the applicant has achieved the highest spray impact velocities.

Turning next to FIG. 4, the second illustrated embodiment of the invention involves the substitution for the material delivered to the high velocity high temperature products of combustion of a solid mass of material to be flame sprayed rather than the powder of the embodiment of FIGS. 1-3. However, the major principles employed in the first embodiment of the invention operate equally well for the atomization of material in rod or wire form. In the simplified illustration of the embodiment, schematically "gun" 40 has a body 41 which is provided with a bore 52 within one leg thereof, which bore bears a cylindrical nozzle insert 42 having a venturi nozzle type bore as at 47 including a diverging portion 47*a* and a converging portion 47*b*, downstream and upstream of the smallest diameter portion of the bore at construction 48, respectively. Body 41 also includes a combustion chamber 43 which extends generally the full height of the vertical body portion. Within the lower portion of the cylindrical combustion chamber body 41 is provided a conical projection as at 46 which is at right angles to the axis of combustion chamber. The center of projection 46 is formed with a small diameter bore 53, the conical projection 46 being axially aligned with nozzle insert 42. The top of conical projection 46 terminates slightly upstream from the inner end 42*a* of the nozzle insert 42. The small diameter bore 43 slidably bears an elongated deposit material rod or wire 44 which is positively fed, by way of opposed motor driven rollers 45 sandwiching the wire or rod, towards the venturi nozzle 47 with the end 44*a* of the rod projecting well into the nozzle bore. The nozzle diverging bore portion 47*a* is extended to assure fine atomization of the molten film as it passes from the sharp-pointed terminal end 44*a* of the wire or rod 44 upon melting. The operation of the second embodiment of the invention is identical to that of the first embodiment. Oxygen under pressure is fed to the combustion chamber 43 through oxygen feed supply passage 53, while a liquid or gaseous fuel enters the combustion chamber through fuel supply passage 54, the flow of oxygen and fuel being indicated by the arrows as shown.

As the result of ignition of oxygen and fuel under pressure within combustion chamber 43, the high velocity products of combustion contact wire 44 upstream of the nozzle bore constriction 48. This maximizes heat transfer to the wire assuring rapid melting of its surface layers. The high momentum gases of the nozzle throat or restriction 48 and of the extended nozzle bore 47 assures the fine atomization of the molten film as it passes from the sharp-pointed terminal end of the wire 44*a*. Instead of a metal wire as shown at 44, a ceramic rod may be used in exactly the same way and fed in similar fashion by powered driving of the opposed set of rollers 45. Again, due to the nature of introduction of the metal wire 44 or a ceramic rod, which projects axially beyond the small diameter bore 53 of the conical projection 46 into the elongated nozzle bore, upstream of throat 48 and with the converging gas jet due to the presence of the conical projection 46 and its alignment with the inlet end of the nozzle bore 47, the molten particles suspended in the high velocity gas stream of supersonic velocity are maintained well away from the wall of the diverging bore portion 47*a* with the metal or ceramic molten particles exiting from the discharge end of the nozzle insert in an essentially cylindrical core 50. This may be on the order of ⅛ inch in diameter corresponding to the molten powder particles exiting from the elongated nozzle bore 25 of the embodiment of FIGS. 1-3 inclusive. Preferably, the length of the nozzle bore beyond the point of introduction of the flow of powder or rod or solid wire form should have a length of at least five times that of the minimum diameter of the nozzle bore, that is, at the throat or smallest restrictions for the nozzle bore.

Additionally, the pressure within the combustion chamber should be maintained at 150 PSIG or greater in both embodiments.

Referring next to FIG. 5, a further embodiment of the invention is illustrated in which only the nozzle and immediately adjacent components of the ultra-high velocity flame spray apparatus indicated generally at 60 are shown. In this embodiment, optimum results are obtained when rotational components of the hot gas flow emanating from the combustion chamber (not shown) are eliminated at the point where the hot gas flow contacts the metal particles to be passed at high velocity through the nozzle bore of the flame spray apparatus 60. With respect to the embodiment of FIG. 5, like elements to that of the embodiment of FIGS. 1, 2 and 3 are provided with like numeral designations. The multiple holes 19 converge towards the axis of the extended nozzle passage provided by bore indicated generally at 25 for the spray apparatus formed by a threaded cylindrical metal nozzle insert indicated generally at 11. The holes 19 for optimum performance must lie in plane common to the nozzle bore axis for bore 25. As a result, there will no directional component radial to the bore axis, and the total flow through the bore 25 is free of tangential, whirling components. Under these conditions, maximum nozzle lengths are possible without particle build up on the nozzle wall. A nozzle length of nine inches operates satisfactorily using a straight bore (no venturi expansion) as in the previously described embodiment of FIGS. 1-3 inclusive.

For a bore 25 whose major portion 25b downstream of the throat provided by converging inlet portion 25a, is of 5/16 inch diameter. Thus, a length to diameter ratio of nearly 30 to 1 is experienced in the embodiment of FIG. 5.

Although the principles of operation in which the particles are spaced away from the nozzle bore wall throughout the length of the nozzle portion 25b as well as 25a, is fully understood, increase of nozzle length to certain critical values is of extreme importance to maximize the effectiveness of the supersonic flame spray resulting from the use of the apparatus and under the method of the present invention. Such parameters and their criticality may be seen by further reference to FIGS. 6 and 7.

In FIG. 5, the typical nozzle provided by nozzle insert 11 of extended bore length involves converging section 25a which is conical and intersects the constant diameter extended length portion 25b of the bore 25 and forming the throat of the nozzle bore. The converging section wall 25a commences at the circumference outlining the outer wall of the part bearing flame orifices or holes 19. As illustrated, powder in a flow of carrier gas passes into the converging portion 25a of the nozzle bore through a central passage 21 coaxial with the bore and opening thereto upstream of the throat.

Figure 6:
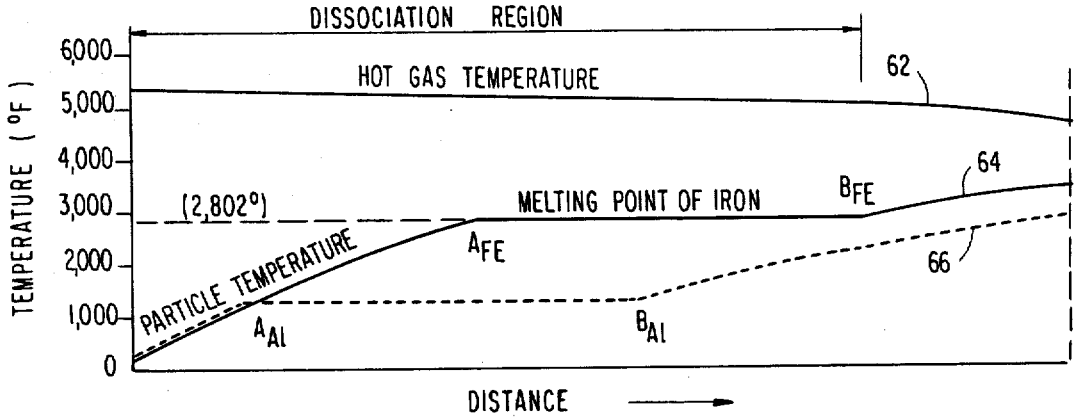
FIG. 6 is a plot of hot gas and metal particle temperatures versus distance for the carrier gas and iron and aluminum particles passing through the bore of the nozzle of FIG. 5 under exemplary use.

With this in mind, FIG. 6 traces the temperature history of the gases, as at line 62, and in this case iron particles, and aluminum as at lines 64, 66 respectively passing through the nozzle. For a propane oxygen flame, the products of combustion approximate 5400° F. at the entrance to the nozzle bore 25. The temperature gradient of these gases along the nozzle bore is initially low due to the re-combination of the dissociated speciae. With full re-combination, the gradient increases. Heat from the flame gases pass to the walls of the nozzle body and to the lower temperature particles.

Illustratively, an iron particle enters the nozzle bore at about 70° F. At first, its temperature increases rapidly within the region of intense dissociation. The particle has its temperature remain constant at 2802° F., when it reaches its melting point $A_{FE}$. The constant temperature occurs up until the particle is molten at point $B_{FE}$. Beyond $B_{FE}$, the molten metal again increases in temperature as is illustrated by the solid line. The dotted plot line 66 includes points $A_{Al}$ and $B_{Al}$ and illustrate the significant temperature differences experienced by a lower melting temperature particle such as aluminum. It also experiences an initially constant temperature once the particle reaches its melting point which continues until the particle is completely molten. As a particle travels down the bore of the nozzle, its temperature steadily increases. The solid and dotted line curves for iron and aluminum respectively are of similar form.

Figure 7:
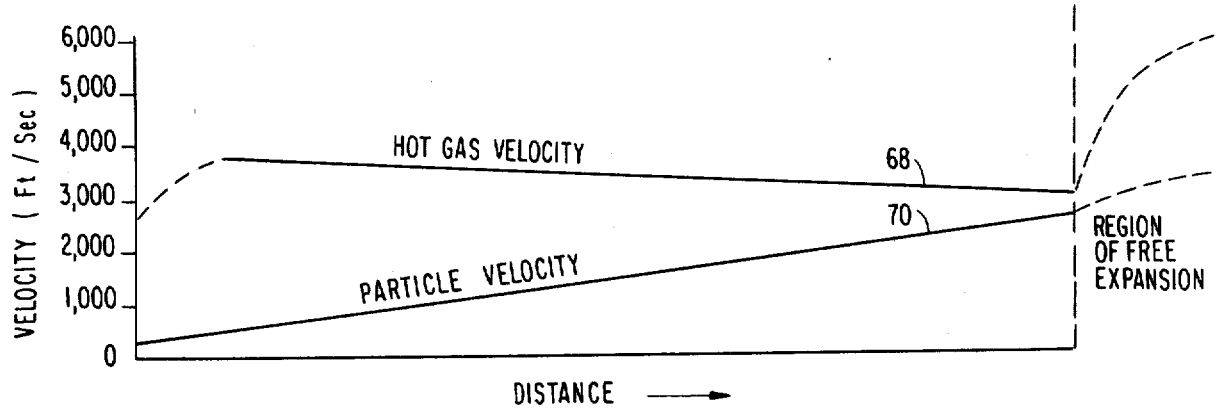
FIG. 7 is a plot of hot gas and particle velocities against distance during passage through the nozzle of the embodiment of FIG. 5.

Referring next to FIG. 7, this figure is a plot of velocity times distance rather than temperature times distance as is the plot of FIG. 6. FIG. 7 shows, at line 68, a steady decrease in gas velocity with loss of temperature for a particle passing through the nozzle bore. The point to point velocity value is that of the sonic velocity in the gas at the particular temperature. Beyond the nozzle, assuming an underexpanded condition, a free expansion of the gases into the free atmosphere leads to a very rapid increase in velocity.

Where the purpose is to accelerate particles, the optimum condition is at the nozzle throat; in the case of FIG. 5 the condition carries throughout the extended length constant diameter bore portion 25b. Therefore, a long straight nozzle will accelerate a particle, as seen by plot line 70, more rapidly than a divergent nozzle designed to maximize gas velocity. On the other hand, the divergent nozzle increases the radial path length the particle must travel to reach the wall. As may be appreciated, a straight or constant diameter bore nozzle would "plug" first.

The particle envelope core 26 of FIG. 5 hypothesis one theory of particle passage through an extended nozzle. There will, of course, be local perturbations in particle velocity which will impart a radial velocity to the particles. If the axial velocity is sufficiently greater than its radial component, the particle could issue from the nozzle passage prior to a radial motion equivalent to the nozzle bore radius. Therefore, there would be no bore wall impact during movement of the particle as it exits from passage or hole 21 into the converging bore portion 25a of the nozzle 11.

This hypothesis may be true for a majority of the particles, but it is possible that some may reach the nozzle wall within bore portion 25b. They do not stick (thus building up a plug) as the angle of impact is so very small due to the high axial velocity. In addition, as may be appreciated at least to the extent of point $B_{FE}$ and $B_{Al}$, FIG. 6, which plots correspond lengthwise to bore 25 of nozzle 11, the particle particularly where it is introduced in solid particle from at the end of hole or passage 21 to the high temperature gase exiting from the combustion chamber, is in a plastic state, that is, it is heat softened but is not at liquification although at near liquification. Thus, the heat softened or plastic particles simply bounce off the metal surface upon contact therewith.

Whether the separated core flow or particle bouncing theory controls, the same practical result occurs. Beyond a certain distance along the nozzle, a build up of impacting particles will result. This is particularly true where the impacting particles result from melting of a solid rod rather than the introduction of solid particles through passage 21 into the high velocity converging gas stream emanating from holes 19. In either case, the nozzle length must be restricted to less than the value wherein build up occurs.

As unforeseen advantage of the use of extended nozzles is the lowered temperature of the jet gases impinging on the work being sprayed. The longer the nozzle, the less this deleterious heating. This is particularly true where these gases are cooled to below the dissociation point. Dissociated specie recombining on a cool surface present a tremendous heat source and thus require means for dissipating such heat at the spray application point.

The discussion above and the plots illustrated in FIGS. 6 and 7 concern one particle of given material and size. For given reactants and flow rates, an optimum nozzle length may be determined by tests. Change of material or particle size distribution will lead to different nozzle lengths. For example, by reference to the dotted line lower plot in FIG. 6, for aluminum, the molten point $B_{Al}$ is reached far upstream of the nozzle bore exit. Plugging will thus occur sooner for aluminum than for iron and its alloys.

Where a long nozzle length for aluminum is desired, a reduction in the hot gas temperature curve will delay melting. This may be accomplished by diluting the oxygen flow with inert gas; i.e., adding air to the flow stream.

Longer nozzles are also possible using an increased bore diameter. To keep the same values of specific momenta, increased reactance flows are necessary to compensate for the increase in bore diameter. Additionally, delay in melting can result by increasing the average particle diameter where the material introduced through hole 21 is in solid particle form.

In summary, the invention maximizes the heating and acceleration of sprayed particles by using high nozzle bore length to diameter ratios. These ratios are only possible using a columnated hot gas flow, particularly where the whirling component is purposely minimized or eliminated. In some case, as in spraying of high temperature ceramics, the oxy fuel flame may not be hot enough to provide adequate melting of the particles. In this case, the combustion reaction must be replaced by electrically heating the flow gas.

When a wire or rod is used in place of the powdered material, that is, in solid particulate form, in the form and manner illustrated in FIG. 4, the rod begins to increase in temperature until a liquid film forms on its surface. The hot high velocity gases sweep this film from the tip of the rod passing axially longitudinally along the nozzle bore. Thus, each particle produces a break up of this film and is molten. It would appear that the mode of possible particle impingement and build up on the bore wall is the impaction of fully liquid material rather than plastic particles as occurs in the powdered particle situation. Thus, the maximum nozzle lengths for wire and rod is shorter than that where powdered material is introduced to the hot gas supersonic flow stream.

While the invention has been particularly shown and described with reference to preferred embodiments thereof, it will be understood by those skilled in the art that various changes in form and details may be made therein without departing from the spirit and scope of the invention.

What is claimed is:

1. In a flame spray method comprising the steps of:

continuously combusting, under pressure, a continuous flow of an oxy-fuel mixture confined within an essentially closed internal burner combustion chamber, discharging the hot combustion product gases from the combustion chamber through a flow expansion nozzle as a high velocity hot gas stream, and feeding material to said stream for high temperature heat softening or liquefaction and spraying at high velocity onto a surface positioned in the path of the stream at the discharge end of the nozzle, the improvement wherein the step of feeding said material comprises introducing said material in solid form outside of said combustion chamber and axially into a converging flow of hot combustion product gases after exit from the combustion chamber while entering a converging portion of the flow expansion nozzle having a nozzle bore of a length that is at least five times that of the nozzle bore throat, to restrict the diameter of the column of particles passing through the nozzle bore, to prevent build-up of particle material on the nozzle bore wall while insuring sufficient particle dwell time within the bore to effect particle heat softening or melting and flow at supersonic flow velocity prior to impact against said surface.

2. The flame spray method as claimed in claim 1, wherein the step of discharging the hot combustion product gases from the combustion chamber through a flow expansion nozzle as a high velocity gas steam includes the step of minimizing the whirling velocity component of the gaseous flow through the flow expansion nozzle bore.

3. The flame spray method as claimed in claim 1, wherein the step of discharging the hot combustion product gases from the combustion chamber through a flow expansion nozzle as a high velocity gas stream comprises causing said gases to pass through said nozzle bore over a nozzle bore length of such an extent that the temperature of the hot gas flow is reduced to below the dissociation temperature of the gas flow.

4. The flame spray method as claimed in claim 1, wherein said step of discharging the hot combustion product gases from the combustion chamber through a flow expansion nozzles as a high velocity gas stream comprises passing said hot combustion product gases through a nozzle whose length is such that the particles discharged are still in their plastic state.

5. The flame spray method as claimed in claim 1 further comprising the step of adding an inert gas to the reactants to reduce the combustion temperature.

6. The flame spray method as claimed in claim 1, further comprising the step of adding compressed air to supply inert gas contained in the compressed air to the reactants to reduce the combustion temperature and to thereby prevent plugging of the nozzle bore by heat softening or molten material particles on the bore of the nozzle upstream of the exit end of the nozzle bore.

7. The flame spray method as claimed in claim 1, wherein said step of feeding said solid material into the flow of hot gases comprises the introduction of said solid material from a hole aligned with the axis of the nozzle bore upstream of the nozzle and at a point where the inlet flow of the hot gases to the nozzle bore throat has a radial velocity component which tends to restrict the diameter of a column of particles when said solid material is in particulate form and which maximizes heat transfer between the hot gases and the case of the rod when the solid material is in rod form and projects into the axis of the nozzle bore, through said hole.

8. The flame spray method as claimed in claim 1, wherein the pressure within the combustion chamber is maintained at least 75 PSIG.

9. A highly concentrated supersonic material flame spray apparatus comprises:

a spray gun body, a high pressure essentially closed combustion chamber within said body, means for continuously flowing an oxy-fuel mixture under high pressure through said combustion chamber for ignition within said chamber, said body including combustion chamber products of combustion discharge passage means at one end thereof, said body further comprising an elongated nozzle downstream of said combustion chamber discharge passage means, said nozzle including a converging inlet bore portion leading to a throat and having an extended length outlet bore portion, and wherein said bore has a length that is at least five times the diameter of said nozzle bore throat, said combustion chamber discharge passage means comprising means for conveying a converging flow of the discharging hot products of combustion, after exit from the combustion chamber into the entrance of the nozzle inlet bore portion and means for introducing material in solid form outside of the combustion chamber axially into the hot combustion gases for subsequent heat softening or melting and acceleration with the point of introduction of the solid material being at the entrance to or within the converging inlet portion of the bore of said nozzle to restrict the diameter of the column of particles passing through the nozzle bore, prevent build-up of particle material on the nozzle bore wall while insuring sufficient particle dwell time within the gas stream to effect particle heat softening or melting prior to particle impact on a substrate downstream of the discharge end of the nozzle bore.

10. The apparatus as claimed in claim 9, wherein the axis of the nozzle bore and the axis of the combustion chamber are at approximately right angles to each other, said combustion chamber comprises an end wall, said combustion chamber discharge passage means comprises a plurality of circumferentially spaced converging, inclined small diameter passages within said combustion chamber end wall, being open at one end to the inlet portion of said nozzle bore upstream of the nozzle bore throat and at the other end to said combustion chamber, and wherein said means for introducing solid material into the hot gases comprises a small diameter material feed passage within said body centered within said circumferentially spaced, inclined passages which converge towards the axis of the bore, said material feed passage being coaxial with said nozzle bore.

11. The apparatus as claimed in claim 9, wherein said combustion chamber comprises an elongated cylindrical combustion chamber, and said body comprises a conical projection within said combustion chamber at approximately right angles to the axis of said combustion chamber and projecting towards and being coaxial with said nozzle bore, and wherein the tip of said conical projection terminates adjacent the end of said nozzle at said converging inlet portion and forms, with said nozzle, said combustion chamber discharge passage means, and wherein said solid material comprises an elongated wire or rod and said conical projection includes an axially extending small diameter bore, and said apparatus further comprises means for positively feeding said solid material wire or rod through the axial bore of said conical projection with the wire or rod opening to the throat of said nozzle at the tip end of said conical projection.

12. The apparatus as claimed in claim 10, wherein said plurality of circumferentially spaced converging, inclined small diameter passages for feeding the combustion chamber gases into the nozzle bore are oriented to eliminate tangential flow into said nozzle bore for minimizing the whirling velocity component of the gaseous flow through the nozzle bore.

13. The apparatus as claimed in claim 12, wherein said plurality of circumferentially spaced converging, inclined small diameter passages are coplanar with the axis of said nozzle bore.

14. The apparatus as claimed in claim 13, wherein the nozzle bore length is the maximum length in which particle build up is not effected on the inner bore surface.

15. The apparatus as claimed in claim 13, wherein the nozzle bore is the minimum length in which the temperature of the hot gas flow is reduced to below the dissociation temperature of the gas flow.

16. The apparatus as claimed in claim 13, wherein the nozzle length is such that the particle velocity is maximized at the exit plane of the nozzle.

17. The apparatus as claimed in claim 13, wherein the nozzle length is such that the particle temperature is maximized at the exit plane of the nozzle.

* * * * *